US011605248B2

(12) United States Patent
Oswald

(10) Patent No.: US 11,605,248 B2
(45) Date of Patent: Mar. 14, 2023

(54) SYSTEMS AND METHODS FOR COMMUNICATING VEHICULAR EVENT ALERTS

(71) Applicant: Westinghouse Air Brake Technologies Corporation, Wilmerding, PA (US)

(72) Inventor: James A. Oswald, Coggon, IA (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 217 days.

(21) Appl. No.: 16/722,827

(22) Filed: Dec. 20, 2019

(65) Prior Publication Data

US 2021/0192863 A1 Jun. 24, 2021

(51) Int. Cl.

| | |
|---|---|
| ***G07C 5/00*** | (2006.01) |
| ***G07C 5/12*** | (2006.01) |
| ***G07C 5/08*** | (2006.01) |

(52) U.S. Cl.

CPC ..... *G07C 5/008* (2013.01); *G07C 5/0816* (2013.01); *G07C 5/12* (2013.01)

(58) Field of Classification Search

CPC ..... G07C 5/008; G07C 5/0816; G07C 5/12; H04W 4/46; H04W 4/40; H04W 4/44; H04W 4/48

See application file for complete search history.

(56) References Cited

U.S. PATENT DOCUMENTS

| | | | | |
|---|---|---|---|---|
| 10,007,263 | B1 * | 6/2018 | Fields | B60W 50/045 |
| 10,971,013 | B2 * | 4/2021 | Bielby | G08G 1/052 |
| 2009/0292459 | A1 * | 11/2009 | Zuccotti | G08G 1/096791 701/1 |
| 2012/0123617 | A1 * | 5/2012 | Noffsinger | B61L 15/0081 701/19 |
| 2015/0009331 | A1 | 1/2015 | Venkatraman | |
| 2016/0297454 | A1 * | 10/2016 | Shubs, Jr. | B61L 15/0072 |
| 2017/0253258 | A1 * | 9/2017 | Bramucci | B61L 27/0005 |
| 2021/0124340 | A1 * | 4/2021 | Isaac | G05B 23/0221 |

* cited by examiner

*Primary Examiner* — James J Lee
*Assistant Examiner* — Steven Vu Nguyen
(74) *Attorney, Agent, or Firm* — The Small Patent Law Group LLC; Philip S. Hof

(57) ABSTRACT

Methods and systems for managing events in a vehicle network are provided. The method includes receiving an event signal indicative of an event from one or more first nodes operably coupled to a first onboard controller of a first vehicle. The event signal is generated in response to a user-based instruction or based on output from one or more sensors. The method determines event information associated with the event and the first vehicle. The event information includes sensed parameter data or image data. The method communicates an event alert containing the event information to one or more second vehicles operating in a designated range of the first vehicle and one or more offboard control systems that control movement of at least the first vehicle and the one or more second vehicles.

16 Claims, 4 Drawing Sheets

SYSTEMS AND METHODS FOR COMMUNICATING VEHICULAR EVENT ALERTS

FIELD

The subject matter described herein relates to methods and systems for managing events in a vehicle network.

BACKGROUND

Collision avoidance is a feature implemented on or in association with a vehicle control system to allow vehicles on the network to move without colliding with other vehicles or obstacles. On many types of vehicle control networks, collision avoidance systems are important in reducing the number and severity of accidents, as well as saving lives. Upon the occurrence of an event (e.g., a collision, a fouled pathway, a breakdown, or the like), it can be important for one or more vehicles involved in the event communicate information related to the event. The prompt notification of the event to other vehicles in proximity of the event can prevent the involvement of additional vehicles in the event. However, the event may render one or more communication modalities onboard the vehicle(s) inoperable. Additionally or alternatively, crew onboard the vehicle (s) may be physically incapable of initiating a reporting function.

BRIEF DESCRIPTION

In accordance with one or more embodiments described herein, a method is provided that includes receiving an event signal indicative of an event from one or more first nodes operably coupled to a first onboard controller of a first vehicle. The event signal is generated one or more of in response to a user-based instruction or based on output from one or more sensors. The method determines event information associated with the event and the first vehicle. The event information includes one or more of sensed parameter data output from the one or more sensors or image data captured by one or more optical sensors operably coupled to the first onboard controller. The method communicates an event alert containing the event information to one or more second vehicles operating in a designated range of the first vehicle and one or more offboard control systems that control movement of at least the first vehicle and the one or more second vehicles.

In accordance with one or more embodiments described herein, a system is provided. The system includes a first onboard controller configured to be disposed onboard a first vehicle. The system also includes one or more first nodes that are configured to be operably coupled with the first onboard controller and disposed onboard the first vehicle. The one or more first nodes are configured to generate an event signal indicative of an event. The event signal is generated one or more of in response to a user-based instruction or based on a value of a sensed parameter of one or more sensors operably coupled to the first onboard controller. The system further includes one or more processors configured to be disposed onboard the first vehicle and operably coupled to one or more of the first onboard controller and the one or more first nodes. The one or more processors are configured to receive the event signal from the one or more first nodes and to determine event information associated with the event and the first vehicle. The event information includes one or more of sensed parameter data output from the one or more sensors or image data captured by one or more optical sensors operably coupled to the first onboard controller. The one or more processors are configured to communicate an event alert containing the event information to one or more second vehicles operating in a designated range of the first vehicle in the vehicle network and one or more offboard control systems configured to control movement of at least the first vehicle and the one or more second vehicles.

In accordance with one or more embodiments described herein, a system is provided. The system includes a first onboard controller of a first vehicle located within a vehicle network. The first controller is configured to receive an event signal indicative of an event. The first onboard controller is configured to obtain sensor data associated with the event from one or more sensors and to communicate an event alert including the sensor data and image data associated with the event from one or more optical sensors to one or more second vehicles operating in a designated range of the first vehicle.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein provide for systems and methods that are configured to communicate (e.g., send and/or receive) signals indicative of events involving vehicles. These events can be adverse events (e.g., accidents, emergency brake situations, etc.) or other types of events. The signals can be communicated from one or more nodes operably coupled to an onboard controller of a vehicle. A node can be any device that is operable to send and/or receive data or other signals. The signals can be generated in response to user-based instructions and/or based on output from one or more sensors. The systems and methods determine event information associated with the event and the vehicle. The event information can include one or more of sensed parameter data output from the one or more sensors or image data captured by one or more optical sensors operably coupled to the first onboard controller. The systems and methods communicate event alerts containing the event information to one or more other vehicles operating in a designated range of the vehicle and one or more offboard control systems that control movement of at least the vehicle and one or more other vehicles operating in the vehicle network. The systems and methods improve communication of events in vehicle networks by reporting events in a manner that reduces the risk presented by the event to other vehicles in the vehicle network. Additionally or alternatively, the systems and methods improve the emergency response to the event itself by indicating the type and extent of the event so that appropriate levels of and types of emergency responses can be deployed to the location of the event.

Figure 1:
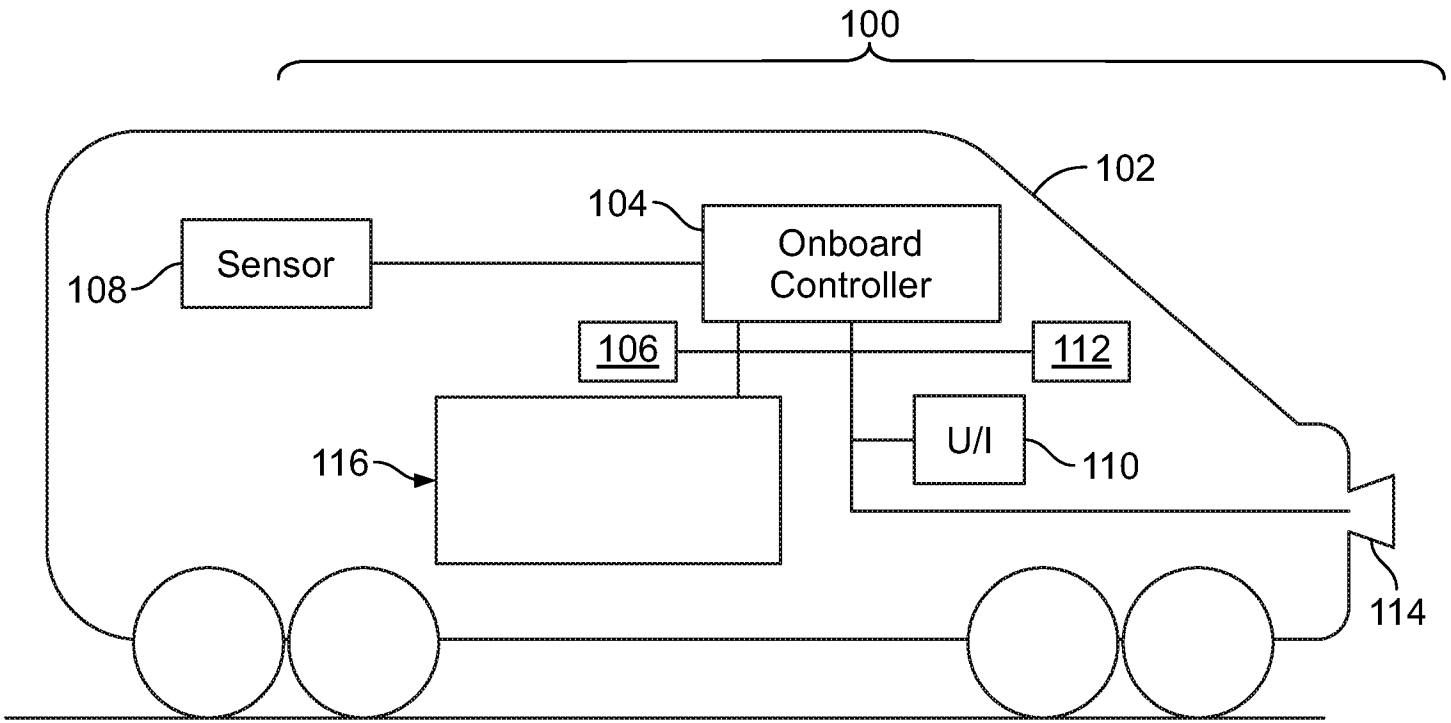
FIG. 1 illustrates an example of a vehicle communication system implemented in a vehicle in accordance with one or more embodiments described herein.

FIG. 1 illustrates an example of a vehicle communication system implemented onboard a vehicle in accordance with one or more embodiments described herein. The system 100 is disposed onboard a vehicle 102. The term "vehicle" shall refer to any system for transporting or carrying one or more passengers and/or cargo. Types of vehicles 102 include automobiles, trucks, buses, rail vehicles (e.g., one or more locomotives and/or one or more rail cars), agricultural vehicles, mining vehicles, aircraft, industrial vehicles, marine vessels, automated and semi-automated vehicles, autonomous and semi-autonomous vehicles, and the like. The vehicle 102 can be connected with one or more other vehicles logically and/or mechanically, such as one or more locomotives connected with one or more rail cars, to form at least part of a consist. The term "consist," or "vehicle consist," refers to two or more vehicles or items of mobile equipment that are mechanically or logically coupled to each other. By logically coupled, the plural items of mobile equipment are controlled so that controls to move one of the items causes a corresponding movement in the other items in consist, such as by wireless command. An Ethernet over multiple unit (eMU) system may include, for example, a communication system for use transmitting data from one vehicle to another in consist (e.g., an Ethernet network over which data is communicated between two or more vehicles). In one example of a consist, the vehicle 102 can be capable of propulsion to pull and/or push additional vehicles or other mobile equipment, either capable or incapable of propulsion, carrying passengers and/or cargo (e.g., a train or other system of vehicles).

The vehicle 102 includes an onboard controller 104 and one or more first nodes 106 configured to be operably coupled to the onboard controller 104. The one or more first nodes 106 are also configured to be disposed onboard the vehicle 102. The onboard controller 104 can control operation of the vehicle 102. Among other things, the onboard controller 104 can control operation of a propulsion system (not shown) onboard the vehicle 102. Optionally, in the case of a consist where the vehicle 102 is the lead vehicle, the onboard controller 104 can be configured to provide control signals to other vehicles in the consist. The onboard controller 104 is configured to be operably coupled with one or more nodes 106, one or more sensors 108, one or more optical sensors 114, one or more user interfaces 110, one or more processors 112, and one or more communications modules 116.

In accordance with one or more embodiments described herein, the on-board controller 104 can implement a control system (e.g., a positive train control system or other system including positive control functionality) that can include a display and operational controls. The control system can be positioned in a cabin of a vehicle 102 (e.g., in an automobile, in a lead vehicle of a consist) and can monitor the location and movement of the vehicle 102 within a vehicle network. For example, the control system can enforce travel restrictions including movement authorities that prevent unwarranted movement of the vehicle 102 into certain route segments. Additionally or alternatively, the control system can allow the vehicle to enter certain route segments unless or until a signal from an off-board controller 104 tells the vehicle 102 to not enter into the segment. Based on travel information generated by the vehicle network and/or received through the communications module 116, the control system can determine the location of the vehicle 102, how fast the vehicle can travel based on the travel restrictions, and, if movement enforcement is performed, to adjust the speed of the vehicle 102. The travel information can include features of the pathways (e.g., railroad tracks, shipping lanes, roads, or the like), such as geometry, grade, currents (e.g., water currents, electrical currents, and the like), etc. Also, the travel information can include travel restriction information, such as movement authorities and speed limits, which can be dependent on a vehicle network zone and/or a pathway. The travel restriction information can also account for vehicle 102 state information (e.g., length, weight, height, etc.). In this way, vehicle collisions, over speed accidents, incursions into work zones, and/or travel through improperly managed junctions among pathways can be reduced or prevented. As an example, the control system may provide commands to the propulsion system of the vehicle 102 and, optionally, to propulsion systems of one or more additional trailing vehicles, to slow or stop the vehicle 102 (or consist) in order to comply with a speed restriction or a movement authority. It will be appreciated that the onboard controller 104 may also implement, in addition to or in lieu of positive controls, one or more of negative controls, open loop controls, closed loop controls, or the like without departing from the scope of the inventive subject matter discussed herein.

The system 100 includes one or more processors 112 and a non-transitive storage device (implemented as part of one or more of the onboard controller 104, one or more nodes 106, and/or the communications module 116) that holds instructions. When executed, the instructions perform operations to control the system 100 to, among other operations, receive event signals, determine event information, and communicate event information to one or more other vehicles and/or one or more offboard control systems. The one or more vehicles can be operating within a designated range of the vehicle 102. The one or more offboard control systems can be configured to control movement of at least the vehicle 102 and one or more other vehicles. For example, the storage device includes instructions that, when executed by the processor(s) 112 perform operations for managing an event in accordance with one or more embodiments described herein. The one or more processors 112 can be disposed onboard the vehicle 102 and operably coupled to one or more of the onboard controller 104, the one or more first nodes 106, and/or the communication module 116. The one or more processors 112 can include and/or represent one or more hardware circuits or circuitry that includes and/or is operably coupled with one or more computer processors (e.g., microprocessors) or other electronic logic-based devices. For example, the one or more processors 112 can be implemented in one or more of the onboard controller 104, one or more nodes 106, one or more communication modules 116, or other on-board communication-enabled devices.

The communications module 116 can provide one or more types of transceivers for communicating, among other things, event alerts over different communication paths in accordance with one or more embodiments described herein. The communications module 116 may represent a discrete device or be distributed among one or more of the controller 104 and the one or more nodes 106. The one or more processors 112 may select one or more different communication paths for managing an event alert or may communicate the event alert via all available and/or operational communication paths. For example, the controller 104 may include a subset of types of transceivers (e.g., wireless network transceivers) while one or more nodes include a different subset of types of transceivers (e.g., radio frequency transceivers and/or wireless network transceivers). Additionally or alternatively, the controller 104 may include a subset of types of transceivers that is the same as and/or exclusive of the subset of types of transceivers included on one or more nodes 106. It will be appreciated that additional transceivers for different communication paths may be provided or that one or more of the communications pathways discussed above may be omitted without departing from the scope of the inventive subject matter discussed herein.

The sensors 108 can include speed sensors (e.g., Hall effect sensors or the like), accelerometers, pressure sensors, humidity and/or temperature sensors (e.g., thermopiles, thermocouples, thermistors, and the like), position sensors (e.g., linear position and/or angular position sensors), level sensors, chemical sensors, optical sensors, or the like. Sensors 108 can be configured to measure various properties including, but not limited to, one or more of speed, acceleration, position, orientation, vibration, pressure, temperature, humidity, and/or liquid level.

The optical sensors 114 may include forward-facing cameras in that the optical sensor 114 is oriented towards the space in front of the vehicle 102. The optical sensors 114 may also include cameras oriented to face other directions and/or features of interest. Additionally or alternatively, one or more optical sensors 114 may be disposed inside the vehicle 102. For example, the vehicle 102 may include a cab camera disposed inside a cab of the vehicle 102. Additionally or alternatively, one or more optical sensors 114 may be implemented in a mobile communications device that may also be a node 106. The optical sensors 114 can obtain static (e.g., still) images and/or moving images (e.g., video) as image data. The optical sensors 114 can continuously or intermittently record image data and/or record image data 114 in response to a control signal generated by the one or more processors 112 (e.g., in response to receiving an event signal).

In accordance with one or more embodiments described herein, one or more nodes 106 can include and/or be operably coupled to one or more sensors 108 (inclusive of one or more optical sensors 114), one or more user interfaces 110, one or more processors 112, and one or more communications modules 116. Nodes 106 may be one or more of onboard the vehicle 102, onboard trailing vehicles in a consist, on a person located onboard the vehicle 102 and/or on a person located onboard a trailing vehicle in a consist. A node 106 can be any device that is operable to send and/or receive data or other signals. For example, nodes 106 can be mobile communication devices forming part of the communication module 116, hardwired or wireless units including sensors and/or a user interface implemented on the vehicle 102 in communication with one or more nodes 106, mobile communications devices carried by the crew, and/or the onboard controller 104, or the like. Additionally or alternatively, one or more nodes 106 may form part of a collision and/or derailment detection system implemented as part of or in conjunction with the onboard controller 104.

The one or more nodes 106 onboard the vehicle can be configured to generate an event signal indicative of an event. In accordance with one or more embodiments described herein, the event signal can be generated in response to a user-based instruction received at a user interface 110 operably coupled to the one or more nodes 106 and/or the onboard controller 104. For example, the crew can access a user interface 110 associated with one or more of the onboard controller 104, the communications module 116, or one or more nodes 106 and select a button to generate an event signal upon occurrence of an event. For example, the crew may access a user interface of the onboard controller and execute a function to generate an event signal. Additionally or alternatively, the crew may access a user interface implemented on a personal mobile communications device to execute a function to generate an event signal.

Additionally or alternatively, in accordance with one or more embodiments described herein, the event signal can be generated based on a value of a sensed parameter of one or more sensors 108 operably coupled to the one or more nodes 106 and/or the onboard controller 104 of the vehicle 102 and/or another vehicle 206 passing by the site of the event 212. For example, the event signal can be generated in response to detecting one or more values of speed, position, orientation, vibration, pressure, humidity, or liquid level that meet predetermined criteria for generating an event signal. Examples of predetermined criteria for generating an event signal can include one or more values that fall outside a select range, that fall below or exceed a threshold value, or that do not otherwise occur during normal operation of the vehicle 102. In other examples, the event signal may be generated based on the onboard controller 104 receiving the sensed parameter values. Additionally or alternatively, the event signal may be generated based on one or more nodes 106 receiving the sensed parameter values. The sensed parameter values may be received at nodes 106 including mobile communication devices forming part of the communication module 116 and/or mobile communication devices carried by the crew, and/or hardwired or wireless units including sensors and/or a user interface implemented on the vehicle 102.

Additionally or alternatively, in accordance with one or more embodiments described herein, the event signal can be generated based on a value of a sensed parameter of image data obtained at one or more optical sensors 114 operably coupled to the one or more nodes 106 and/or the onboard controller 104 and/or the onboard controller 104 of the vehicle 102 and/or another vehicle 206 passing by the site of the event 212. For example, the one or more processors 112 may examine the image data obtained by one or more of the optical sensors 114. In one aspect, the one or more processors 114 can examine the image data by determining, based on benchmark features (e.g., tracks, a horizon, etc.) and/or images (e.g. images from the camera in an operational orientation, etc.), whether certain conditions exist at the vehicle 102. Based on similarities or differences between one or more sets of image data and the benchmark features and/or images, the processor 112 can determine if the image in the field of view of the optical sensor 114 that is shown in the analyzed imaged data is misaligned (e.g., in the case of the vehicle rolling over to a non-operational orientation). In an additional or alternative example, another vehicle 206 passing by an accident vehicle 102 can report the event 212 (e.g., the camera in the other vehicle 206 can detect an accident involving other vehicles and communicate an event alert based on the event).

The one or more processors 112 can be configured to receive the event signal from the one or more nodes 106 and/or the onboard controller 104. Based on receiving the event signal, the one or more processors 112 can determine event information associated with the event and the vehicle 102. The event information can include sensed parameter data output from one or more sensors 108. Additionally or alternatively, the event information can include image data captured by one or more optical sensors 114 operably coupled to the onboard controller 104. Additionally or alternatively, the event information can include one or more of a medical attention indicator, a vehicle count indicator, a hazardous condition indicator. The medical attention indicator can be indicative of a requested medical response. For example, based on a vehicle carrying primarily cargo and having few passengers or a passenger train carrying many passengers, the medical attention indicator could indicate a requested medical response that is appropriate based on the number of potentially injured passengers. The vehicle count indicator can be indicative of a number of vehicles associated with the event. For example, based on a collision between multiple vehicles or based on an event affecting one or more vehicles of a consist, the vehicle count indicator can transmit a number or estimated number of vehicles involved in and/or affected by the event. The hazardous condition identifier can be indicative of a requested hazardous condition response. For example, based on a vehicle carrying a hazardous substance or breach of a vehicle carrying a hazardous substance, the hazardous condition identifier can notify relevant authorities and/or emergency responders of the hazardous substance. Additionally or alternatively, the event information can include one or more of a vehicle identification, a vehicle location, or vehicle consist information.

The one or more processors 112 optionally can confirm the event prior to communicating the event alert. Confirmation of the event signal can take place before, after, or as part of determining the event information. The one or more processors 112 can confirm the event by obtaining a confirmation signal from one or more users at the user interface 110, that may be implemented as part of the onboard controller 104, a node 106, and/or a mobile communications device, to the one or more nodes 106 and/or the onboard controller 104. For example, the one or more processors 112 can transmit a request for confirmation that can be presented on the user interface 110 associated with one or more of or all of the onboard controller 104, one or more nodes 106 equipped with a user interface 110, or on one or more personal mobile communication devices associated with the system 100 (which may also or may not be nodes 106). Additionally or alternatively, the one or more processors 112 can confirm the event by obtaining additional and/or different (e.g., in time or location) values of one or more sensed parameters that exceed a threshold value from the one or more sensors 108 and/or the one or more optical sensors 114. Examples of sensed parameter values for confirming an event signal can include one or more values that fall outside a select range, that fall below or exceed a threshold value, or that do not otherwise occur during normal operation of the vehicle 102. For example, based on receiving an event signal generated by a crew at the onboard controller, the one or more processors 112 can confirm the event by obtaining acceleration values indicative of a sudden stop, orientation values/signatures of the vehicle 102 indicative of a non-operational orientation of the vehicle 102, temperature values exceeding or falling below normal environmental and/or operational values, and the like. Additionally or alternatively, the one or more processors 112 can confirm the event by obtaining and examining image data captured by the one or more optical sensors 114. For example, the one or more processors 112 can confirm the event by obtaining and examining image data from by determining, based on benchmark features (e.g., tracks, a horizon, etc.) and/or images (e.g. images from the optical sensor in an operational orientation, etc.), whether certain conditions exist at the vehicle 102 as described above.

The one or more processors 112 can communicate the event alert containing the event information to one or more other vehicles operating in a designated range of the first vehicle in the vehicle network and/or one or more offboard control systems configured to control movement of the vehicle 102 and other vehicles as discussed further below.

Figure 2:
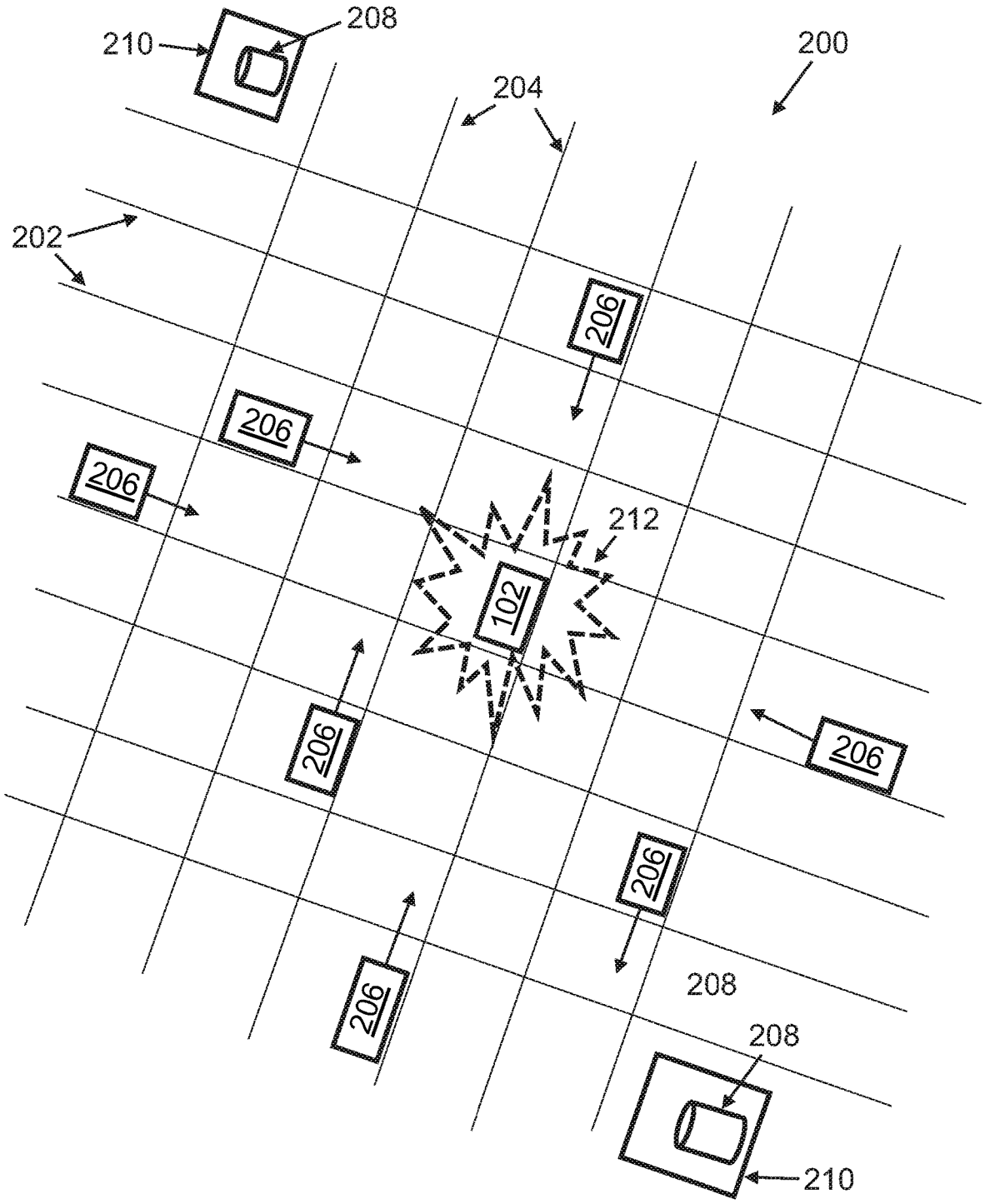
FIG. 2 illustrates an example vehicle network for implementing an event communication system in accordance with one or more embodiments described herein.

FIG. 2 illustrates an example vehicle control network 200 on which an event communication system can be implemented in accordance with one or more embodiments described herein. The terms "vehicle control network" and "vehicle network" shall mean a control network implemented among one or more vehicles 102, 206 and/or one or more offboard control systems 108. Vehicle networks 200 are capable of communicating and/or implementing one or more of positive controls, negative controls, open loop controls, closed loop controls, or the like. Vehicle networks 200 may be used to manage one or more of vehicles, types of vehicles, modes of transport, traffic on ways, and the like associated with the vehicle network 200. Vehicle networks 200 may manage pathways 204 designed for one or more types of vehicles 102, 206. Additionally or alternatively, vehicle networks 200 may manage the same or different types of vehicles 102, 206. Vehicle networks 200 may exist in a static or dynamic geographic domain or among a select vehicle population. Vehicle control networks 200 may also be formed on an ad-hoc basis between a plurality of vehicles 102, 206. Non-limiting examples of vehicle networks 200 include vehicular ad hoc networks, positive train control networks, industrial autonomous vehicle control networks, and the like.

The vehicle network 200 includes a plurality of pathways 204 that can be designed for one or more types of vehicles 102, 206. The term "pathway" shall mean any road or other way on land, air, or water, including all public and private roads, tracks, and routes, regardless of any entity responsible for maintenance of the way (e.g., a private entity, a state entity, a provincial entity, a county entity, an international entity, or the like). The one or more processors 112 can communicate an event alert containing the event information to one or more other vehicles 206 operating in a designated range of the vehicle 102 in the vehicle network 200 and one or more offboard control systems 208 configured to control movement of at least the first vehicle and the one or more second vehicles.

The one or more offboard control systems 208 may be implemented remotely (e.g., a remote office, a virtual office, or one or more remote servers or the like) or at one or more wayside locations 110 in the vehicle network 200. Wayside devices 210 may embody different devices located along pathways 204. Non-limiting examples of wayside devices 210 include signaling devices, switching devices, communication devices, etc. The wayside device 110 can include offboard control systems 108. In one example, the offboard control systems 108 provides travel information to the vehicles 102, 106 operating in the vehicle network 200. Wayside devices 210 can also include wireless access points that enable appropriately equipped vehicles 102, 206 in range to connect to one or more radio and/or wireless networks associated with the vehicle network 200. The onboard controller 104, one or more nodes 106, or one or more communication modules 116 onboard the vehicles 102, 206 of the vehicle network can dynamically establish network sessions with available radio and/or wireless networks through such wayside devices 210 to relay data communication between vehicles 102, 206 of the vehicle network 200 and/or one or more offboard control systems 208 associated with the vehicle network 200.

Upon the occurrence of an event 212, the one or more processors 112 onboard the vehicle 102 receive an event signal. The event signal may be generated by a crew accessing the user interface 110 and selecting an event reporting function at the user interface 110 operably coupled to the one or more nodes 106 and/or the onboard controller 104. For example, the crew can access a user interface 110 associated with the onboard controller 104 (e.g., a PTC controller) and/or or one or more nodes 106 (e.g., a personal mobile communications device, a wired terminal, or a wireless terminal, etc.). Additionally or alternatively, the event signal 212 may be automatically generated by one or more nodes 106. For example, one or more nodes 106 may represent a collision and/or derailment detection system. Based on sensed parameters indicative of an event 212, the one or more nodes 106 may automatically generate an event signal regardless of the availability of the crew. The system 100 optionally can confirm the event 212 by generating a request for user confirmation and/or confirming the event 212 based on sensed parameters. Based on receiving and optionally confirming the event signal, the one or more processors determine event information associated with the event 212. For example, the event information can include one or more of sensed parameter data output from one or more sensors 108, image data captured by one or more optical sensors 114, a medical attention indicator, a vehicle count indicator, a hazardous condition indicator, a vehicle identification, a vehicle location, or vehicle consist information. The event alert and the event information facilitates prompt notification of the event information to the onboard controllers of other vehicles 206 within a predetermined range of the event 212, to dispatchers associated with the vehicle network 200, to emergency responders, and other interested parties.

In accordance with one or more embodiments here in, the one or more processors 112 can be configured to indirectly communicate the event alert, including event information, from the vehicle 102 to the one or more other vehicles 206 via one or more offboard control systems. For example, the system 100 may be implemented as a function of a control system (e.g., a PTC system). The event alert can be communicated either automatically through a control system implemented on a wireless network associated with the vehicle control system. Based on receiving an event alert, the control system can control the movements of one or more other vehicles 206 operating in a designated range of the vehicle 102 and/or the event 212. In other examples, a dispatcher of the control system can review the image data transmitted as part of the event information to allow instant assessment of the nature and severity of the event. Additionally or alternatively, the one or more processors 112 can be configured to directly communicate the event alert, including the event information, from the vehicle 102 to one or more second nodes associated with a corresponding second onboard controller of the one or more other vehicles 206. For example, the event alert can be communicated to onboard controllers of the other vehicles. In response, the onboard controllers of the other vehicles can create a stop target and stop the other vehicles before reaching locations affected by the event 212 (e.g., fouled, damaged, or blocked pathways).

Figure 3:
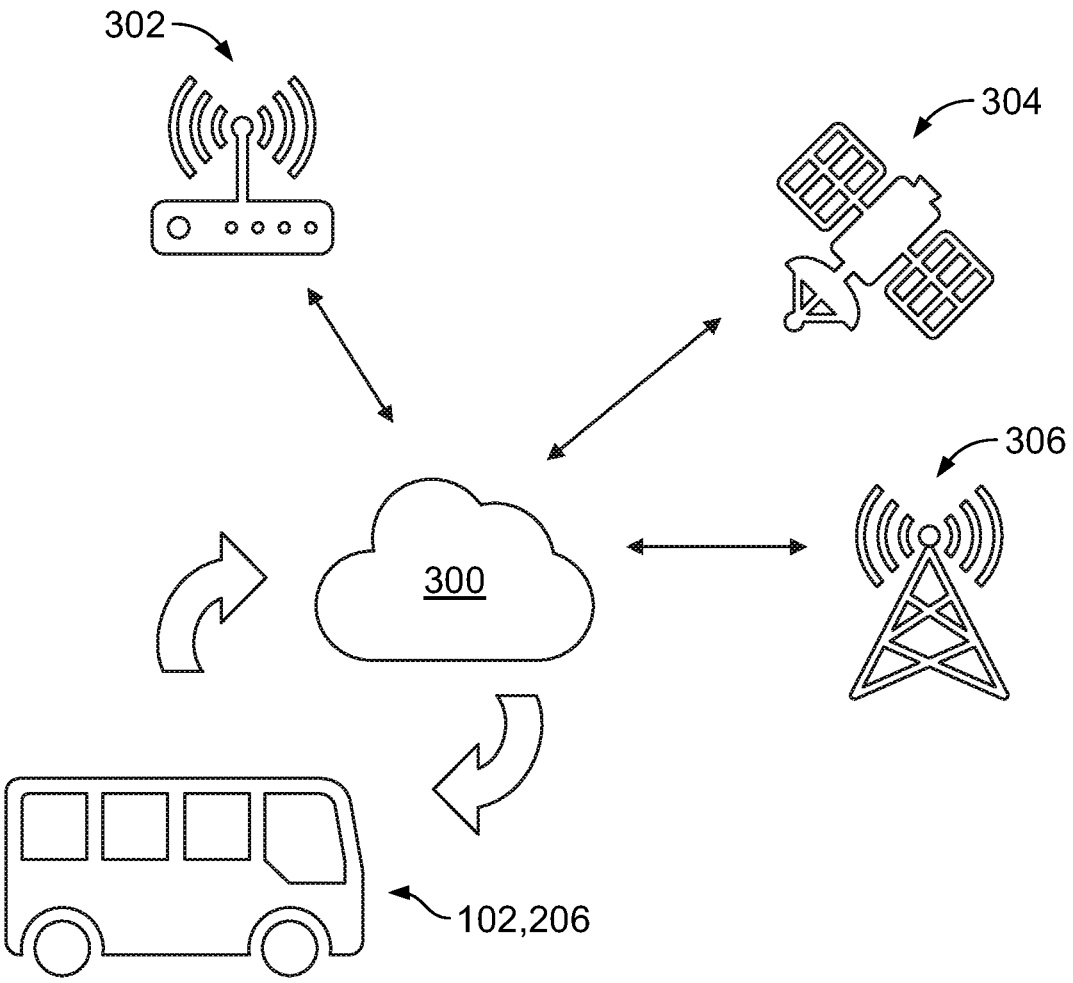
FIG. 3 illustrates an example of a communications network for managing an event in accordance with one or more embodiments described herein.

FIG. 3 illustrates a block diagram of an example of a communications network for managing an event 212 in accordance with one or more embodiments described herein. The communications network 300 can include one or more of a wireless network 302, a satellite network 304, or a radio network 306. The vehicles 102, 206 on the vehicle network 200 can include, as part of the communication module 116, one or more of a wireless transceiver, a satellite transceiver, or a radio transceiver. The wireless transceivers, satellite transceivers, or radio transceivers may be implemented as part of one or more of the onboard controller 104 and/or one or more onboard nodes 106.

The wireless network 302 can be provided by wireless access points implemented in the vehicle network 200. As the vehicles 102, 206 travel through different travel zones, the wireless network device 408 onboard the vehicles 102, 206 can detect different wireless network access points provided by wayside devices 210 or other communication devices along the pathways 204 of the vehicle network 200. In one example, a single wireless network 302 covers a travel territory, and different wayside devices 210 provide access points to the wireless network 302. Non-limiting examples of protocols that wireless network devices follow to connect to the wireless network 402 include IEEE 802.11, Wi-Max, Wi-Fi, and the like. In one example, the wireless network communications operate around the 220 MHz frequency band. By relaying vehicle data communications through the wireless network 402, communications, including event alert communications, can be made more reliable, especially in conditions where direct radio communication can be lost.

The satellite network 304 utilized by the vehicle network 200 can be provided by one or more satellites. The vehicles 102, 206 can transmit and receive data communications relayed through one or more satellites via satellite transceivers implemented as part of the onboard controller 104, one or more nodes 106, or the communications modules 116 onboard the vehicles 102, 206. In one example, a satellite transceiver can receive vehicle location information from a third-party global position system to determine the location of the respective vehicle 102, 206. The vehicles 102, 206 can communicate directly with each other via the satellite network 304 or the vehicles 102, 206 can communicate indirectly with each other through one or more offboard control systems 208 associated with the vehicle network 200.

The radio frequency (RF) network 306 utilized by the vehicle network 200 can be provided by one or more RF communications towers and RF repeaters. The vehicles 102, 206 can transmit and receive RF data communications relayed through one or more RF communications networks via radio transceivers onboard the vehicles 102, 206 implemented as part of the onboard controller 104, one or more nodes 106, or the communications modules 116 onboard the vehicles 102, 206. In some embodiments, an RF transceiver includes a cellular radio transceiver (e.g., cellular telephone module) that enables a cellular communication path. In one example, the cellular radio transceiver communicates with cellular telephony towers located proximate to the pathways 204 of the vehicle network 200. For example, radio transceivers enables data communications between the vehicles 102, 206 directly through a third-party cellular provider. Additionally or alternatively, radio transceivers enable data communication between the vehicles 102, 206 and a remote office associated with the vehicle network 200 and/or the one or more offboard control systems 208 through a third-party cellular provider. In one embodiment, each of two or more vehicles in the system (e.g., consist) have radio transceivers for communicating with other vehicles 102, 206 in the vehicle network and/or with other vehicles in the consist through the third-party cellular provider.

Figure 4:
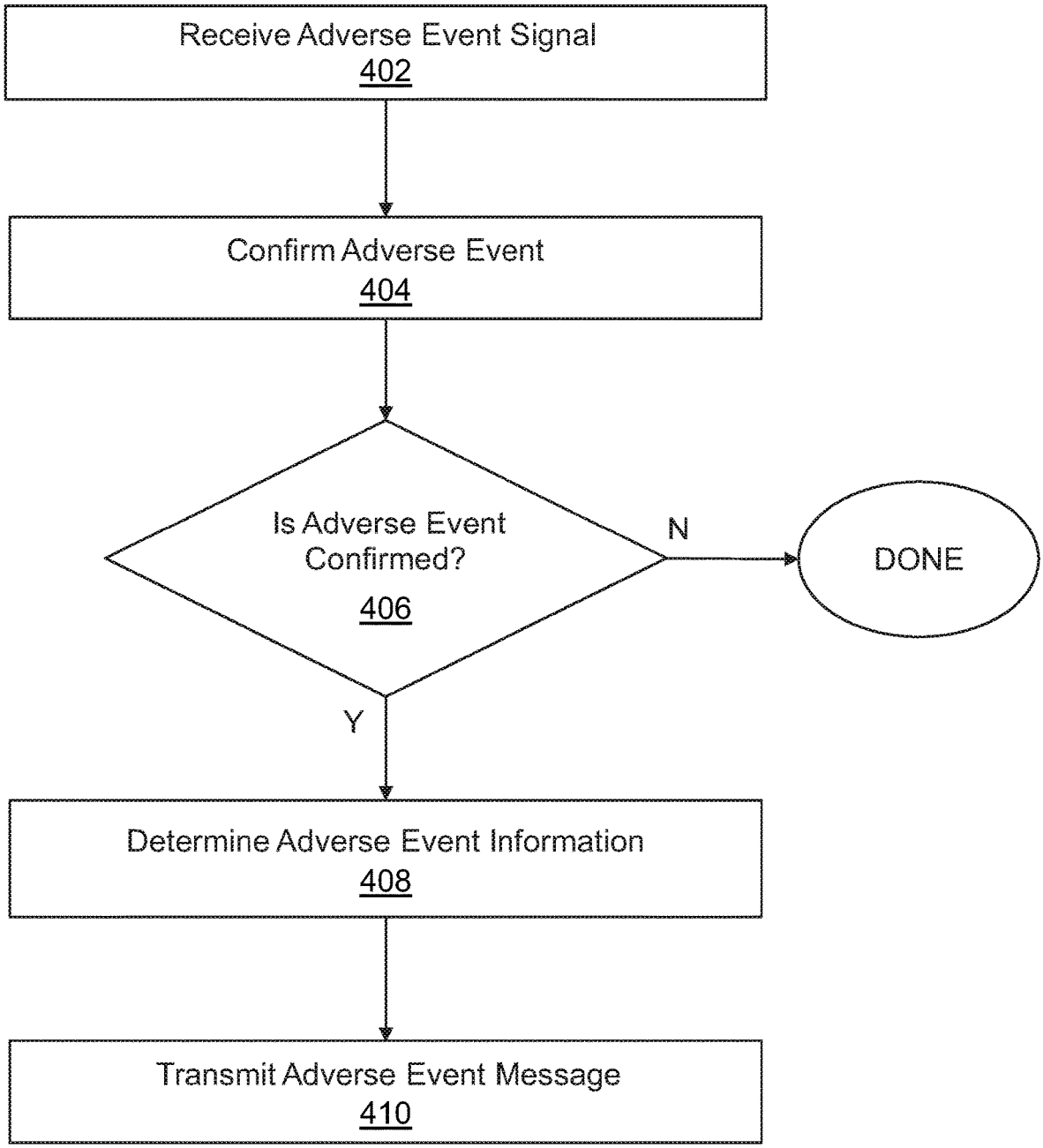
FIG. 4 illustrates an example method for managing an event in accordance with one or more embodiments described herein.

FIG. 4 illustrates an example process for managing an event in accordance with one or more embodiments described herein. The operations of FIG. 4 are carried out by one or more processors 112 in response to execution of program instructions, such as in applications stored in a storage medium implemented on one or more nodes 106, a storage medium implemented on the onboard controller 104, and/or other on-board communications-enabled devices. Optionally, all or a portion of the operations of FIG. 4 may be carried out without program instructions, such as in an image signal processor associated with the optical sensor 114 that has the corresponding operations implemented in silicon gates and other hardware. It should be recognized that while the operations of method 400 are described in a somewhat serial manner, one or more of the operations of method 400 may be continuous and/or performed in parallel with one another and/or other operations of the nodes 106 and/or the onboard controller 104.

At 402, the one or more processors 112 receive an event signal indicative of an event 212 from one or more first nodes 106. The one or more first nodes 106 are operably coupled to a first onboard controller 104 of a vehicle 102. The event signal is generated in response to a user-based instruction and/or based on output from one or more sensors. For example, the event signal can be generated in response to a user-based instruction received at a user interface 110 operably coupled to the one or more nodes 106 and/or the onboard controller 104. For example, the crew can access a user interface 110 associated with one or more of the onboard controller 104, the communications module 116, or one or more nodes 106 and execute a function to generate an event signal. Additionally or alternatively, the event signal can be generated based on a value of a sensed parameter of one or more sensors 108 and/or one or more optical sensors 114 operably coupled to the one or more nodes 106 and/or the onboard controller 104. For example, one or more sensors 108, one or more optical sensors 114, and one or more nodes 106 may form all or part of a collision and/or derailment detection system. The event signal can be generated in response to one or more values of speed, position, orientation, vibration, pressure, humidity, or liquid level that meet predetermined criteria for generating an event signal or based on certain conditions present in image data (e.g., misalignment of benchmark features in the image data compared to benchmark image data). Based on receiving an event signal, the process continues.

Optionally, at 404 and 406, the one or more processors 112 confirm the event 212. Confirmation of the event signal can take place before, after, or as part of determining the event information. The one or more processors 112 may confirm the event 212 based on generating a request for and receiving a confirmation signal initiated by one or more users at a user interface 110 of the onboard controller 104, a node 106, and/or a mobile communications device. Additionally or alternatively, the one or more processors 112 can confirm the event by obtaining additional and/or different (e.g., in time or location) values of one or more sensed parameters that exceed a threshold value from the one or more sensors 108 and/or the one or more optical sensors 114. Examples of sensed parameter values for confirming an event signal can include one or more values that fall outside a select range, that fall below or exceed a threshold value, or that do not otherwise occur during normal operation of the vehicle 102. For example, based on receiving an event signal generated by a crew at the onboard controller 104, the one or more processors 112 can confirm the event by obtaining acceleration values indicative of a sudden stop, orientation values/signatures of the vehicle 102 indicative of a non-operational orientation of the vehicle 102, and the like. Additionally or alternatively, the one or more processors 112 may confirm the event 212 by obtaining one or more image attributes of interest present in the image data captured by the one or more optical sensors 114. For example, the one or more processors 112 can confirm the event by obtaining and examining image data from by determining, based on benchmark features (e.g., tracks, a horizon, etc.) and/or images (e.g. images from the optical sensor in an operational orientation, etc.), whether certain conditions exist at the vehicle 102 as described above. Based on the one or more processors 112 being unable to confirm the event 212 or receiving confirmation that the event alert was generated in error, the process interprets the event signal to not represent an event and the process ends. Based on the one or more processors 112 confirming the event 212, the process interprets the event 212 to have occurred and the process continues.

At 408, the one or more processors 112 determine event information associated with the event 212. The event information can include one or more of sensed parameter data output from one or more sensors 108, image data captured by one or more optical sensors 114. The event information may also include one or more of a vehicle identification, a vehicle location, or vehicle consist information. Additionally or alternatively, the event information can include a medical attention indicator indicative of a requested medical response (e.g., a number an extent of potentially injured crew and passengers, potential types of injuries such as chemical exposure and/or burns), a vehicle count indicator indicative of a number of vehicles associated with the event 212, or a hazardous condition indicator indicative of a requested hazardous condition response (e.g., notice that the vehicle 102 contains a hazardous substance).

At 410, the one or more processors 112 communicate the event alert, including the event information, to one or more other vehicles 206 operating in a designated range of the vehicle 102 and/or the event 212 and one or more offboard control systems 108 that control movement of at least the vehicle 102 originating the event alert and one or more other vehicles. In one example, the event alert may be directly communicated from the vehicle 102 to one or more second nodes operably coupled to a corresponding second onboard controller of the one or more other vehicles 206. Based on receiving the event alert, the corresponding second onboard controllers can generate a stop target and stop the vehicle 206 and/or reroute the vehicle 206 to avoid the area of the event 212. Additionally or alternatively, the event alert may be indirectly communicated from the vehicle 102 to the one or more other vehicles 206 via the one or more offboard control systems 208. The event alert may be one or more of relayed to the one or more other vehicles 206 and or emergency response services automatically (e.g., without dispatcher action) or relayed to a dispatcher for manual assessment of the severity of the event 212 and further action based thereon. For example, the dispatcher can attempt to contact the crew and/or alert emergency response services based on the type and extent of the event 212. Accordingly, events 212 are reported in a manner that reduces the risk presented by the event 212 to other vehicles 206 in the vehicle network 200 and improves the response to the event 212 itself by indicating the types of and extent of emergency responses needed.

Optionally, in accordance with one or more embodiments herein, the event alert may be directly communicated from the first vehicle to one or more second nodes operably coupled to a corresponding second onboard controller of the one or more second vehicles.

Optionally, in accordance with one or more embodiments herein, the event alert may be indirectly communicated from the first vehicle to the one or more second vehicles via the one or more offboard control systems.

Optionally, in accordance with one or more embodiments herein, the event information may include one or more of a medical attention indicator indicative of a requested medical response, a vehicle count indicator indicative of a number of vehicles associated with the event, or a hazardous condition indicator indicative of a requested hazardous condition response.

Optionally, in accordance with one or more embodiments herein, the event information may include one or more of a vehicle identification, a vehicle location, or vehicle consist information.

Optionally, in accordance with one or more embodiments herein, the event alert may be communicated responsive to receiving confirmation of the event.

Optionally, in accordance with one or more embodiments herein, the method may further include receiving the confirmation by one or more of receiving a confirmation signal from one or more users at a user interface of the one or more first nodes, obtaining a value of a sensed parameter of one or more sensed parameters that exceeds a threshold value, or obtaining one or more image attributes of interest present in the image data captured by the one or more optical sensors.

Optionally, in accordance with one or more embodiments herein, the event alert received by the one or more second vehicles may initiate an event avoidance action as a positive vehicle control on a corresponding vehicle controller of the one or more second vehicles.

Optionally, the one or more processors are configured to directly communicate the event alert from the first vehicle to one or more second nodes associated with a corresponding second onboard controller of the one or more second vehicles.

Optionally, the one or more processors are configured to indirectly communicate the event alert from the first vehicle to the one or more second vehicles via one or more offboard control systems.

Optionally, in accordance with one or more embodiments herein, the event information further includes a medical attention indicator indicative of requested medical response based on the event information.

Optionally, in accordance with one or more embodiments herein, the event information further includes one or more of a vehicle identification, a vehicle location, or vehicle consist information.

Optionally, in accordance with one or more embodiments herein, the one or more processors are further configured to confirm the event prior to communicating the event alert.

Optionally, in accordance with one or more embodiments herein, the one or more processors confirm the event by one or more of obtaining a confirmation signal from one or more users at a user interface of the one or more first nodes, obtaining a value of a sensed parameter of one or more sensed parameters that exceeds a threshold value, or obtaining one or more image attributes of interest present in the image data captured by the one or more optical sensors.

Optionally, in accordance with one or more embodiments herein, at least one of the first vehicle or the one or more second vehicles comprises an automobile, a rail vehicle, an agricultural vehicle, a mining vehicle, an aircraft, an industrial vehicle, or a marine vessel.

Optionally, in accordance with one or more embodiments herein, the first onboard controller is configured to directly transmit the event alert from the first vehicle to a corresponding second onboard controller of the one or more second vehicles.

Optionally, in accordance with one or more embodiments herein, the first onboard controller confirms the event prior to communicating the event by one or more of obtaining a confirmation signal from one or more users at a user interface operably coupled to the first onboard controller, obtaining a value of a sensed parameter of one or more sensed parameters that exceeds a threshold value, or obtaining one or more image attributes of interest present in image data captured by the one or more optical sensors.

Optionally, in accordance with one or more embodiments herein, the event alert further comprises one or more of a medical attention indicator, a vehicle count indicator, or a hazardous condition indicator indicative of a requested response based on the event.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the subject matter described herein is not limited in its application to the details of construction and the arrangement of components set forth in the description herein or illustrated in the drawings hereof. The subject matter described herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, in the following claims, the phrases "at least A or B", "A and/or B", and "one or more of A or B" (where "A" and "B" represent claim elements), are used to encompass i) A, ii) B and/or iii) both A and B. For the avoidance of doubt, the claim limitation "the event information further comprises one or more of a medical attention indicator indicative of a requested medical response, a vehicle count indicator indicative of a number of vehicles associated with the event, or a hazardous condition indicator indicative of a requested hazardous condition response" means and shall encompass "i) the event information further comprises a medical attention indicator indicative of a requested medical response", "ii) the event information further comprises a vehicle count indicator indicative of a number of vehicles associated with the event", "iii) the event information further comprises a hazardous condition indicator indicative of a requested hazardous condition response", "iv) the event information further comprises a medical attention indicator indicative of a requested medical response and a vehicle count indicator indicative of a number of vehicles associated with the event", "v) the event information further comprises a vehicle count indicator indicative of a number of vehicles associated with the event and a hazardous condition indicator indicative of a requested hazardous condition response", "vi) the event information further comprises a medical attention indicator indicative of a requested medical response and a hazardous condition indicator indicative of a requested hazardous condition response", and/or "vii) the event information further comprises a medical attention indicator indicative of a requested medical response, a vehicle count indicator indicative of a number of vehicles associated with the event, and a hazardous condition indicator indicative of a requested hazardous condition response".

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A method, comprising:

receiving, at an onboard controller of a first vehicle, an event signal indicative of an event on a vehicular pathway;

determining event information associated with the event on the vehicular pathway and the first vehicle, the event information including image data captured by one or more optical sensors operably coupled to the onboard controller;

confirming an occurrence of the event by obtaining one or more image attributes of interest present in the image data captured by the one or more optical sensors, wherein the image attributes of interest are indicative of the event;

responsive to confirming the occurrence of the event, establishing a network session between the onboard controller and a communication network via a wireless access point, the wireless access point disposed at a wayside device within a designated range from the first vehicle; and separately communicating, via the communication network, an event alert containing the event information from the first vehicle to one or more offboard control systems and to one or more second vehicles operating in a designated range of the first vehicle, the one or more second vehicles not mechanically connected to the first vehicle and do not operate under control of the first vehicle.

2. The method of claim 1, wherein the event information further comprises one or more of a medical attention indicator indicative of a requested medical response, a vehicle count indicator indicative of a number of vehicles associated with the event, or a hazardous condition indicator indicative of a requested hazardous condition response.

3. The method of claim 1, wherein the event information further comprises one or more of a vehicle identification, a vehicle location, or vehicle consist information.

4. The method of claim 1, wherein the event alert is communicated responsive to confirming the occurrence of the event.

5. The method of claim 1, wherein the event alert is received by the one or more second vehicles and initiates an event avoidance action as a positive vehicle control on a corresponding vehicle controller of the one or more second vehicles.

6. The method of claim 1, wherein the event signal is generated in response to a user-based instruction input on a user interface operably coupled to the onboard controller of the first vehicle.

7. The method of claim 1, wherein establishing the network session between the onboard controller and the communication network is performed by a wireless network device disposed onboard the first vehicle and operably coupled to the onboard controller, the wireless network device configured to implement a wireless communication protocol to establish the network session with the wireless access point at the wayside device.

8. A system, comprising:

an onboard controller configured to be disposed onboard a first vehicle;

a wireless network device configured to be disposed onboard the first vehicle and operably coupled to the onboard controller; and a user interface configured to be disposed onboard the first vehicle and operably coupled to the onboard controller, the user interface configured to generate an event signal, indicative of an event on a vehicular pathway, in response to receiving a user input on the user interface, the onboard controller configured to receive the event signal from the user interface and to determine event information associated with the event, the event information including image data captured by one or more optical sensors operably coupled to the onboard controller;

the onboard controller configured to confirm the event, after receiving the event signal from the user interface, by obtaining one or more image attributes of interest present in the image data captured by the one or more optical sensors, where the image attributes of interest are indicative of the event, and responsive to confirming the event, the wireless network device configured to establish a network session between the onboard controller and a communication network via a wireless access point disposed at a wayside device within a designated range from the first vehicle, and the onboard controller is configured to communicate an event alert containing the event information through the communication network during the network session to one or more second vehicles operating in a designated range of the first vehicle, and to separately communicate the event alert to one or more offboard control systems.

9. The system of claim 8, wherein the first onboard controller is configured to directly communicate the event alert from the first vehicle to the one or more second vehicles via one or more of a wireless network device disposed onboard the first vehicle or a radio transceiver disposed onboard the first vehicle.

10. The system of claim 8, wherein the event information further comprises a medical attention indicator indicative of requested medical response based on the event information.

11. The system of claim 8, wherein the event information further comprises one or more of a vehicle identification, a vehicle location, or vehicle consist information.

12. The system of claim 8, wherein at least one of the first vehicle or the one or more second vehicles comprises an automobile, a truck, a bus, a rail vehicle, an agricultural vehicle, a mining vehicle, an aircraft, an industrial vehicle, or a marine vessel.

13. A system, comprising:

an onboard controller of a first vehicle located within a vehicle network, the onboard controller configured to receive an event signal indicative of an event on a vehicular pathway in the vehicle network, the onboard controller configured to obtain sensor data associated with the event on the vehicular pathway from one or more sensors and image data associated with the event on the vehicular pathway from one or more optical sensors, the onboard controller of the first vehicle further configured to confirm an occurrence of the event by obtaining one or more image attributes of interest present in the image data captured by the one or more optical sensors, wherein the image attributes of interest are indicative of the event; and a wireless network device configured to be disposed onboard the first vehicle and operably coupled to the onboard controller, responsive to confirming the occurrence of the event, the wireless network device configured to establish a network session between the onboard controller and a communication network via a wireless access point disposed at a wayside device within a designated range from the first vehicle;

the onboard controller configured to generate an event alert including the sensor data and the image data, and to control the wireless network device to separately communicate the event alert from the first vehicle through the communication network to one or more offboard control systems and to one or more second vehicles operating in a designated range of the first vehicle, the one or more second vehicles not mechanically connected to the first vehicle and do not operate under control of the first vehicle.

14. The system of claim 13, wherein the event alert further comprises one or more of a medical attention indicator, a vehicle count indicator, or a hazardous condition indicator indicative of a requested response based on the event.

15. The system of claim 13, wherein the event information further comprises one or more of a vehicle identification, a vehicle location, or vehicle consist information.

16. The system of claim 13, wherein at least one of the first vehicle or the one or more second vehicles comprises an automobile, a truck, a bus, a rail vehicle, an agricultural vehicle, a mining vehicle, an aircraft, an industrial vehicle, or a marine vessel.

* * * * *